US007383716B2

(12) United States Patent
Bates et al.

(10) Patent No.: US 7,383,716 B2
(45) **Date of Patent: *Jun. 10, 2008**

(54) TUBE BENDER AND METHOD OF USING SAME

(75) Inventors: Darryle Bates, Cuyahoga Falls, OH (US); Patrick Mulvaney, Solon, OH (US)

(73) Assignee: Stride Tool Inc., Ellicottville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/467,962

(22) Filed: Aug. 29, 2006

(65) Prior Publication Data

US 2006/0283230 A1 Dec. 21, 2006

Related U.S. Application Data

(63) Continuation of application No. 11/115,092, filed on Apr. 26, 2005, now Pat. No. 7,096,707, which is a continuation of application No. 10/647,942, filed on Aug. 26, 2003, now Pat. No. 6,883,360, which is a continuation of application No. 10/272,586, filed on Oct. 15, 2002, now Pat. No. 6,609,405.

(51) Int. Cl.
*B21D 11/04* (2006.01)
*B21D 7/04* (2006.01)

(52) U.S. Cl. ..... 72/459; 72/159; 72/217

(58) Field of Classification Search ..... 72/159, 72/217, 149, 154, 216, 388, 458, 459
See application file for complete search history.

(56) References Cited

U.S. PATENT DOCUMENTS

| | | | | | |
|---|---|---|---|---|---|
| 1,075,837 | A * | 10/1913 | Malo et al. | ..... | 72/459 |
| 1,247,729 | A * | 11/1917 | Scribner | ..... | 72/459 |
| 1,514,467 | A * | 11/1924 | Schonfield et al. | ..... | 72/459 |
| 1,640,426 | A * | 8/1927 | Pike | ..... | 72/458 |
| 1,899,281 | A * | 2/1933 | Lidseen | ..... | 72/159 |
| 2,695,538 | A * | 11/1954 | Parker | ..... | 72/157 |
| 2,804,791 | A * | 9/1957 | Wheeler | ..... | 72/459 |
| 2,979,976 | A * | 4/1961 | Franck | ..... | 72/388 |
| 3,190,105 | A * | 6/1965 | Strybel | ..... | 72/459 |
| 3,336,779 | A * | 8/1967 | Schall | ..... | 72/459 |
| 3,785,190 | A * | 1/1974 | Schall et al. | ..... | 72/218 |
| 3,906,778 | A * | 9/1975 | Crouse | ..... | 72/459 |
| 4,827,755 | A * | 5/1989 | Strybel | ..... | 72/458 |
| 6,463,780 | B1 * | 10/2002 | Kalanish | ..... | 72/388 |
| 6,609,405 | B1 * | 8/2003 | Bates et al. | ..... | 72/459 |
| 6,883,360 | B2 * | 4/2005 | Bates et al. | ..... | 72/459 |
| 7,096,707 | B2 * | 8/2006 | Bates et al. | ..... | 72/459 |

* cited by examiner

*Primary Examiner*—David B Jones
(74) *Attorney, Agent, or Firm*—Benesch, Friedlander, Coplan & Aronoff LLP

(57) ABSTRACT

A tube bender comprising a mandrel, a forming member connected to the mandrel for coaction with the mandrel to effectuate bending of a tube wherein the forming member has at least two bending positions defined thereon, a handle pivotally connected to said forming member, and a release member movable relative to said handle and configured to be secured in a locked position relative to said forming member when said handle is selectively moved to any of one said at least two bending positions thereby preventing relative movement between said handle and said forming member. The release member enables an operator to move the release member to an unlocked position to permit such operator to move the handle relative to the forming member between the at least two bending positions.

19 Claims, 7 Drawing Sheets

TUBE BENDER AND METHOD OF USING SAME

This application is continuation of U.S. application Ser. No. 11/115,092 filed on Apr. 26, 2005, now U.S. Pat. No. 7,096,707 which is a continuation of U.S. application Ser. No. 10/647,942 filed on Aug. 26, 2003, now U.S. Pat. No. 6,883,360 issued on Apr. 26, 2005, which is a continuation of U.S. application Ser. No. 10/272,586 filed on Oct. 15, 2002, now U.S. Pat. No. 6,609,405 issued on Aug. 26, 2003. The entire disclosures of these earlier applications are hereby incorporated by reference.

BACKGROUND OF THE INVENTION

This invention relates to tube bending tools and more particularly to a manually operable tube bender especially suited for effecting bends in excess of 90 degrees.

Manually operated tools for bending tubing are quite old and well known in the art. For example, such tools are widely used by electricians for forming bends in an electrical conduit. Examples of commercial tube benders sold by Stride Tool Inc. and its predecessors are described and claimed in U.S. Pat. Nos. 4,379,360, 4,220,642, 4,289,872, 4,229,873, 4,343,496, 4,379,340, and 4,424,660 ("the Stride patents"). The tools described in the Stride patents are capable of bending tubes up to 180 degrees. While these tools have enjoyed longstanding commercial success, the tools are somewhat awkward for use in effecting bends in excess of 90 degrees because the handles, which are manipulated by an operator to effect the bend, cross over when a tube is being bent beyond 90 degrees. When the handles cross over, manipulation of the tool becomes somewhat awkward and difficult. Moreover, an operator in bringing his hands toward one another through the first 90 degrees after the cross over, an operator's force application is reversed and one is pulling one's hands apart or pressing with crossed arms.

Another tool that has been available commercially for a period of time requires disconnection of one of the handles after a 90 degree bend has been completed by unscrewing the handle from the tool element to which it is connected. The handle is then reconnected by threading it into other threaded recess to effect bending from 90 degrees up to 180 degrees.

Accordingly it would be desirable to produce a manually operated tube bender which is capable of effecting bends up to 180 degrees without handle cross over or the need to disconnect and reconnect one of the handles after 90 degrees of bending has been accomplished.

SUMMARY OF THE INVENTION

In one embodiment according to the present invention, a tube bender comprises a mandrel, a forming member connected to the mandrel for coaction with the mandrel to effectuate at least 180 degree bending of a tube wherein the forming member has at least two bending positions defined thereon, a handle pivotally connected to the forming member, a release member movable relative to the handle wherein the release member is associated with the handle; and engagement means for securing the release member in a locked position relative to the forming member when the handle is selectively moved to any of one the at least two bending positions thereby preventing relative movement between the handle and the forming member. The release member enables an operator to move the release member to an unlocked position to permit such operator to move the handle relative to the forming member between the at least two bending positions.

Preferably, the release member is a sleeve disposed about the handle. The tube bender may further comprise a biasing element, such as a spring, disposed between the sleeve and the handle to resiliently bias the sleeve in a direction towards the forming member. Alternatively, the tube may further comprise a biasing element, such as a spring, disposed between the sleeve and the handle to resiliently bias the sleeve in a direction away from the forming member.

Also, the tube bender may further comprise urging means for permitting an operator to move the release member in an axial direction relative to the handle with at least one finger of the operator's hand that holds the handle. The urging means may comprise an actuation lever having a finger-receiving portion and a coupling portion wherein the finger-receiving portion extends from the release member to enable such operator to actuate the finger-receiving portion of said lever with a finger of the same hand holding the handle without having to reposition such operator's hand. The coupling portion of the lever is operably connected to the release member wherein the activation of the finger-receiving portion of the lever causes the release member to move axially to the unlocked position.

The engagement may comprise a first structure disposed on the forming member defining a first of the at least two bending positions, a second structure disposed on the forming member defining a second of the at least two bending positions, and a complimentary structure disposed on the release member. The complimentary structure engages the first structure when the handle is moved to the first bending position thereby securing the release member in the locked position. The complimentary structure engages the second structure when the handle is moved to the second bending position thereby securing the release member in the locked position. The first structure may define a first notch and the complimentary structure may define a tab that engages the first notch when the handle is moved to the first bending position. The second structure may define a second notch and the complimentary structure may define a tab that engages the second notch when the handle is moved to the second bending position.

In another embodiment according to the present invention, a tube bender comprises a mandrel, a forming member connected to the mandrel for coaction with the mandrel to effectuate at least 180 degree bending of a tube, the forming member having at least two bending positions defined thereon, a following member pivotally connected to the forming member defining a pivot point, a handle movable axially relative to the following member wherein the handle is associated with the following member to thereby permit the handle to rotate about the pivot point relative to the forming member, and engagement means for securing the handle in a locked position relative to the forming member when the handle is selectively moved to any of one the at least two bending positions thereby preventing relative movement between the handle and the forming member. The handle enables an operator to move the handle axially to an unlocked position to permit such operator to move the handle relative to the forming member between the at least two bending positions.

Preferably, the following member is a shaft disposed within a cavity provided in the handle. The tube bender may further comprise a biasing element, such as a spring, disposed between the shaft and the handle to resiliently bias the shaft in a direction towards the forming member. Alternatively, the tube may further comprise a biasing element, such as a spring, disposed between the shaft and the handle to resiliently bias the shaft in a direction away from the forming member.

To move the handle into the unlocked position, the operator may pull the handle in an axial direction away from the following member or the operator may push the handle in an axial direction towards the following member.

In another embodiment according to the present invention, a tube bender comprises a mandrel, a forming member connected to the mandrel for coaction with the mandrel to effectuate at least 180 degree bending of a tube, the forming member having at least two bending positions defined thereon, a handle pivotally connected to the forming member, a release member pivotally connected to the handle, engagement means for securing the release member in a locked position relative to the forming member when the handle is selectively moved to any of one the at least two bending positions thereby preventing relative movement between the handle and the forming member, and an actuation lever operably connected to the release member to enable an operator to actuate the actuation lever thereby moving the release member to an unlocked position to permit such operator to move the handle relative to the forming member between the at least two bending positions.

To move the release member into the unlocked position, the operator may push the actuation lever in an axial direction towards the following member or the operator may pull the actuation lever in an axial direction away from the following member.

In another embodiment according to the present invention, a tube bender comprises a mandrel, a forming member connected to the mandrel for coaction with the mandrel to effectuate at least 180 degree bending of a tube wherein the forming member has a socket in communication with at least two channels defining at least two bending positions in a first plane, a handle having a ball portion disposed in the socket and a shaft portion disposed in one of the at least two channels for securing the handle in a locked position relative to the forming member when the handle is selectively moved to any of one the at least two bending positions thereby preventing relative movement between the handle and the forming member. The handle may be adapted to enable an operator to move the handle into a geometric plane different than the first plane to an unlocked position to permit an operator to move the handle relative to the forming member between the at least two bending positions.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
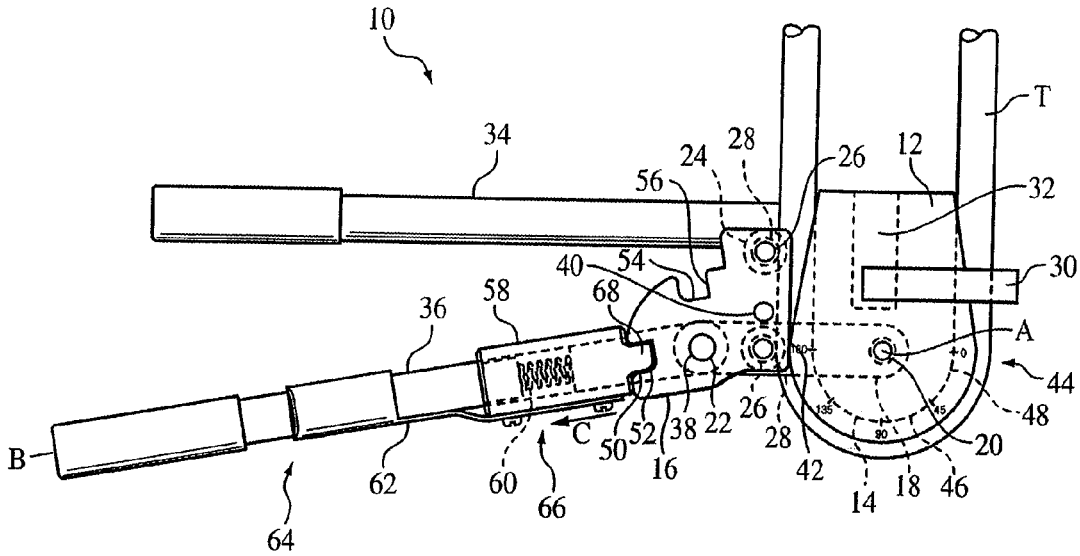
FIG. 1 is an elevated view of tube bender 10 at the completion of a 180 degree bend according to the present invention.

As shown in FIG. 1, a manually operable tube bender 10 according to the present invention comprises a mandrel 12 defining an annular peripheral bending groove 14 and a forming member 16 connected to mandrel 12 by link 18 through a pivotal connection 20 that defines bending axis A. Bending groove 14 extends at least 180 degrees around mandrel 12 and is arcuate in cross section. Link 18 is also connected to forming member 16 through a pivotal connection 22.

Forming member 16 is rotatable both about the coaxial axes of groove 14 and bending axis A and about a spaced and parallel axis of the pivotal connection 22. A pair of former rolls 24 are rotatably mounted in a channel (not shown) of forming member 16. Each former roller 24 includes a complimentary groove 26 disposed around the periphery of the pair of rollers 24. The pair of former rollers 24 are mounted in a spaced relationship by pins 28 which extend through sections of the forming member 16 on opposite sides of the channel (not shown). Preferably, a tube anchoring hook 30 is mounted in a groove 32 in mandrel 12 which is rotatably supported by a pivot pin (not shown) in groove 32.

A tube to be bent T is bent into bending groove 14 by forming member 16 which is swung about the bending axis A of the groove 14 by its connection to mandrel 12 through link 18. Tube T may be a piece of pipe or a section of electrical conduit, or any other flexible material having a circular cross-section. Movement of forming member 16 about bending axis 20 is effected by suitable manipulation of a pair of handles 34 and 36 connected to mandrel 12 and forming member 16, respectively. Handle 36 defines a longitudinal axis B thereon.

Handle 36 is connected to forming member 16 by a pivot connection 38, which is limited in the clockwise direction of movement by the engagement of a stopping pin 40 on forming member 16 engaging an edge surface 42 of link 18. However, handle 36 and forming member 16 connected thereto may be swung in a counterclockwise direction from the position to permit facilitated insertion of the tube T into the bending groove 14 to extend perpendicularly and tangentially to bending groove 14 at a bend start point 44 thereof. Preferably, mandrel 12 is provided with a scale 46 having a zero indicator 48 at bend start point 44 and other angular indications spaced correspondingly therefrom. To permit handle 36 to swing in the counter-clockwise direction, forming member 16 is provided with the channel (not shown) that is dimensioned to allow handle 36 to swing within forming member 16.

Forming member 16 also includes a first retention notch 50 that defines a first bending position 52 and a second retention notch 54 that defines a second bending position 56. Preferably, first bending position 52 is a 0 to 90 degree bending position, while second bending position 56 is a 90 to 180 degree bending position. As shown in FIG. 1, the 0 to 90 degree bending position is oriented 90 degrees from the 90 to 180 degree bending position. Accordingly, handle 36 may be swung between first bending position 52 and second bending position 56 via the channel (not shown). Although two bending positions are illustrated in FIGS. 1-3, one skilled in the art would recognize that more than two bending positions may be provided along forming member 16 as described below and shown in FIG. 7.

Figure 2A:
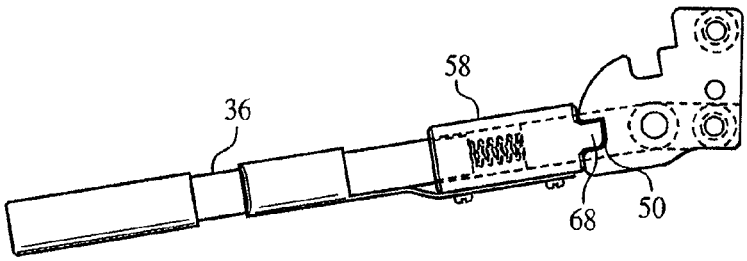
FIG. 2A is an elevated view of a portion of tube bender 10 in the locked position.

A sleeve 58, serving as a release member, is disposed about and in a spring biased relationship with handle 36 wherein spring 60 is biasing sleeve 58 towards forming member 16 such that sleeve 58 is permitted to move in an axial direction relative to handle 36 as indicated by arrow C. Sleeve 58 is provided with an axially extending tab 68, that is complimentary to retention notches 50, 54, to engage first retention notch 50 when sleeve 58 is moved to the first bending position 52 or to engage second retention notch 54 when sleeve 58 is moved to the second bending position 56. When tab 68 of sleeve 58 is moved to engage first retention notch 50 or second retention notch 54 in forming member 16, sleeve 58 is in a locked position to maintain handle 36 in either of its two operating positions as shown in FIG. 2A.

To move sleeve 58 to an unlocked position for purposes of moving sleeve 58 between first and second bending positions 52, an actuation lever 62 is connected to sleeve 58 to enable a user to urge sleeve 58 axially with a finger of the same hand holding handle 36 without having to reposition the operator's hand. Actuation lever 62 includes a finger-receiving portion 64 and a coupling portion 66 wherein the finger-receiving portion 64 extends from sleeve 58 in a position enabling the operator to actuate finger-receiving portion 64 with a finger of the same hand holding handle 36 without having to reposition the operator's hand. The coupling portion 66 of actuation lever 62 is operably connected to sleeve 58 wherein the activation of the finger-receiving portion 64 of actuation lever 62 causes sleeve 58 to move axially to the unlocked position of sleeve 58. For purposes of this application and for the interpretation of the claims, the term "finger" includes all four fingers and the thumb of a human's hand.

Figure 2B:
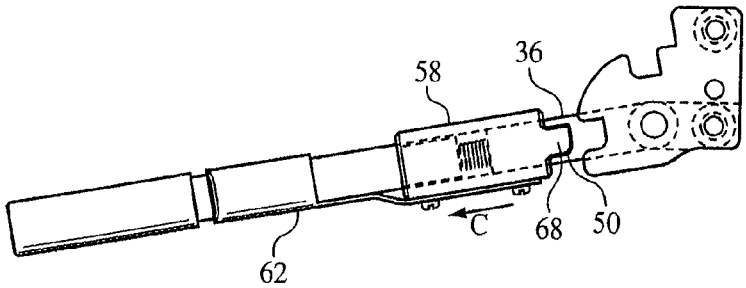
FIG. 2B is an elevated view of a portion of tube bender 10 in the unlocked position.

When it is desired to move handle 36 from one bending position to the other, an operator simply actuates finger-receiving portion 64 of actuation lever 62 in the direction indicated by arrow C against the urging of spring 60 thereby moving sleeve 58 in the unlocked position as shown in FIG. 2B. When sleeve 58 is in the unlocked position, sleeve 58 and thus handle 36 is moveable between the two bending positions (i.e., first bending position 52 (0 to 90 degree) and second bending position 56 (90 to 180 degree)). Sleeve 58 can return to the locked position when the operator releases the actuation lever 62 as spring 60 returns to its normal state.

Although the preferred release member is a sleeve disposed about handle 36, it is obvious to one skilled in the art that the release member may be an internal shaft (not shown) disposed within a cavity (not shown) provided in handle 36. The internal shaft and cavity may be any geometric shape, but it is preferred that the internal shaft and the cavity disposed in handle 36 are cylindrical shaped. In the case of an internal shaft disposed within a cavity in handle 36, the internal shaft is preferably connected to actuation lever 62 through a slot provided in handle 36.

Although the preferred engagement means includes retention notches 50, 54 provided in forming member 16 and a complimentary tab 68 provided on sleeve 58, one skilled in the art would appreciate that any female-type structure may be provided on forming member 16 and any complimentary male-type structure may be provided on sleeve 58 to engage the female-type structure on forming member 16. Further, one skilled in the art would recognize that forming member 16 may include any male-type structure, while sleeve 58 may include any complimentary female-type structure.

Although the preferred urging means is an actuation lever, other urging means may be utilized and still be within the scope of the present invention. Other urging means may include any other physical member connected to sleeve 58 to enable an operator to move sleeve 58 axially with a finger of the same hand holding handle 36 without having to reposition the operator's hand. Furthermore, urging means may include modifications to the sleeve itself to enable an operator to move sleeve 58 axially with a finger of the same hand holding handle 36 without having to reposition the operator's hand. These modifications to sleeve 58 may include, but are not limited to, providing a lip on the end of sleeve 58, providing a contoured surface on sleeve 58, knurling sleeve 58, or any other design modification to sleeve 58 known in the art to provide a surface for an operator to engage to permit axial movement of sleeve 58.

Although FIGS. 1-3 illustrate that handle 36 is connected to forming member 16 and that handle 34 is connected to mandrel 12, it is obvious to one skilled in the art that handle 36 may be connected to mandrel 12 and handle 34 may be connected to forming member 16. In this alternative case, mandrel 12 would include at least two bending positions, preferably a 0 to 90 degree bend position and a 90 to 180 degree bend position. When handle 36 is positioned in the 0 to 90 degree bend position on mandrel 12, handle 36 may be swung around the forming member 16 to effectuate a 90 degree bend. To permit a 180 degree bend, handle 36 would be selectively positioned in the 90 to 180 degree bend position and swung around the forming member 16 to effectuate a 180 degree bend. Obviously, the same is true for any of the embodiments illustrated in FIGS. 4-9.

Figure 3A:
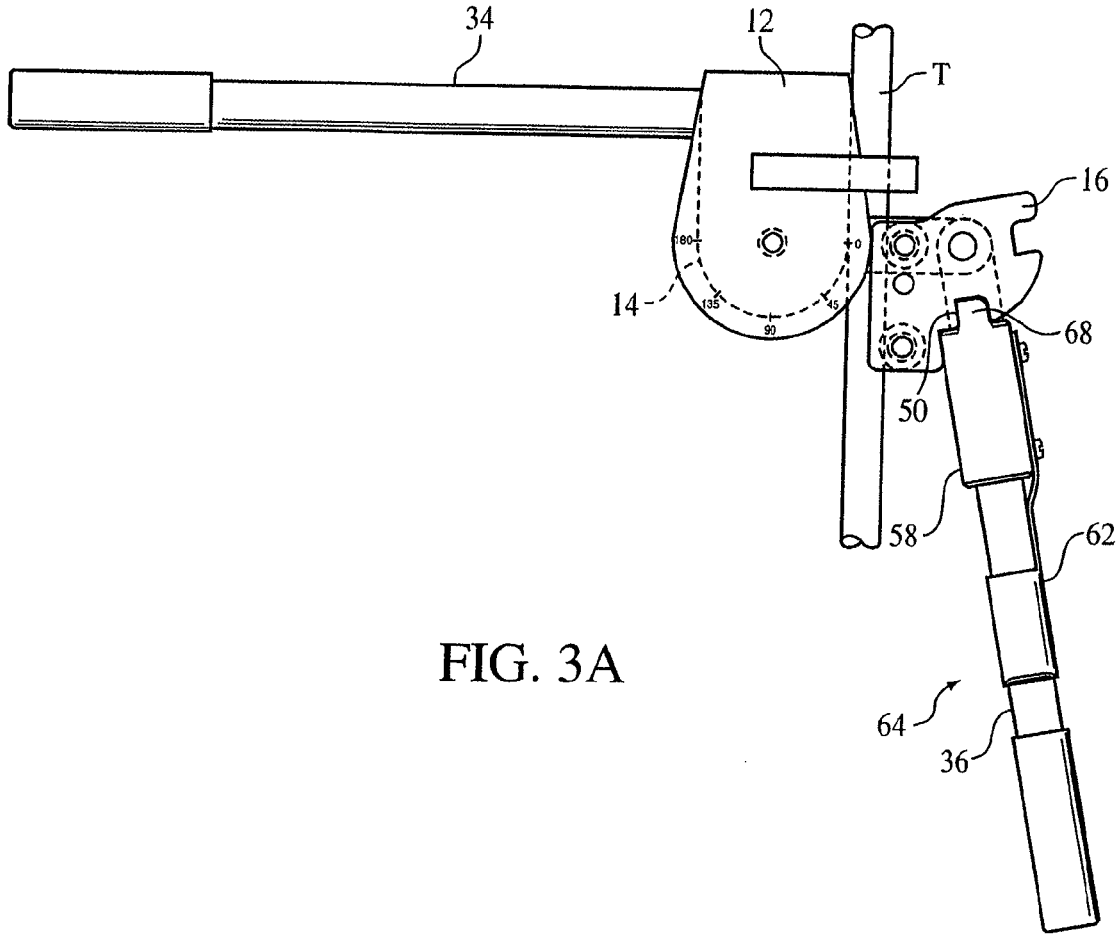
FIGS. 3A-3D are sequential elevated views of tube bender 10 showing the formation of a 180 degree bend.
Figure 3B:
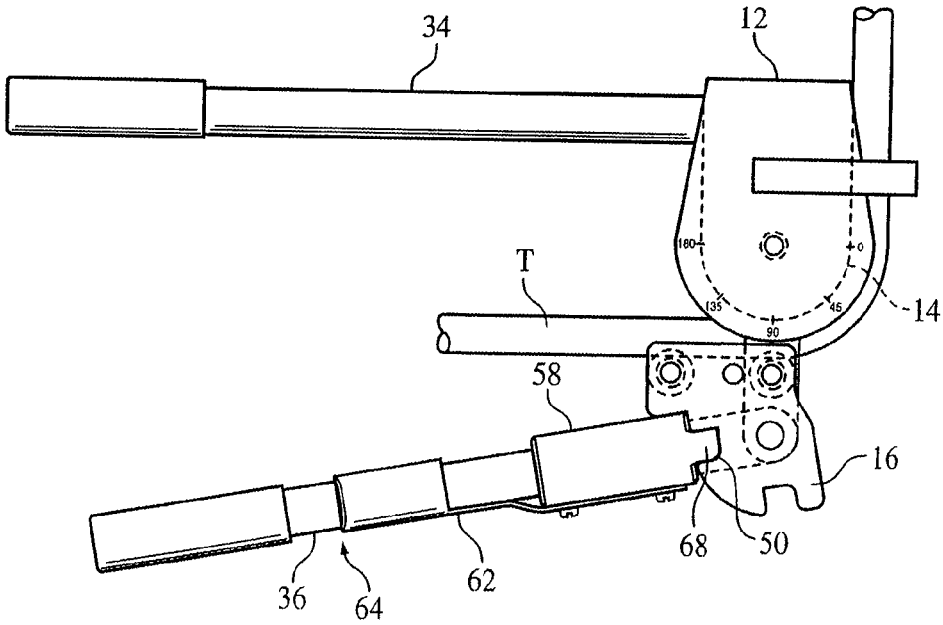

In operation, handle 36 and thus sleeve 58 is first positioned in its 0 to 90 bend position as shown in FIG. 3A. To facilitate this, handle 36 is swung about bending axis A to position link 18, forming member 16, and sleeve 58 as shown in FIG. 3A. When in the 0 to 90 bend position, tab 68 on sleeve 58 engages first notch 50 thereby securing sleeve 58 in the locked position such that handle 36 cannot move relative to forming member 12. Tube T to be bent is positioned adjacent mandrel 12 with an end portion extending into and beyond bending groove 14. Hook 30 is swung to retain the work piece in position. Handle 36 is then manipulated to bring the former rollers 24 into engagement with tube T along a surface portion opposite the portion engaging bending groove 14. Forces manually applied to the handles 34, 36 shift them relatively from the position of FIG. 3A to the position of FIG. 3B thus effecting a 90 degree bend.

Where it is desired to extend the bend beyond 90 degrees, the operator uses his/her finger to pull on the finger-receiving portion 64 of actuation lever 62. This results in sleeve 58 being moved axially away from forming member 16 to its unlocked position against the urging of the spring thereby disengaging tab 68 from first retention notch 50. Handle 36

Figure 3C:
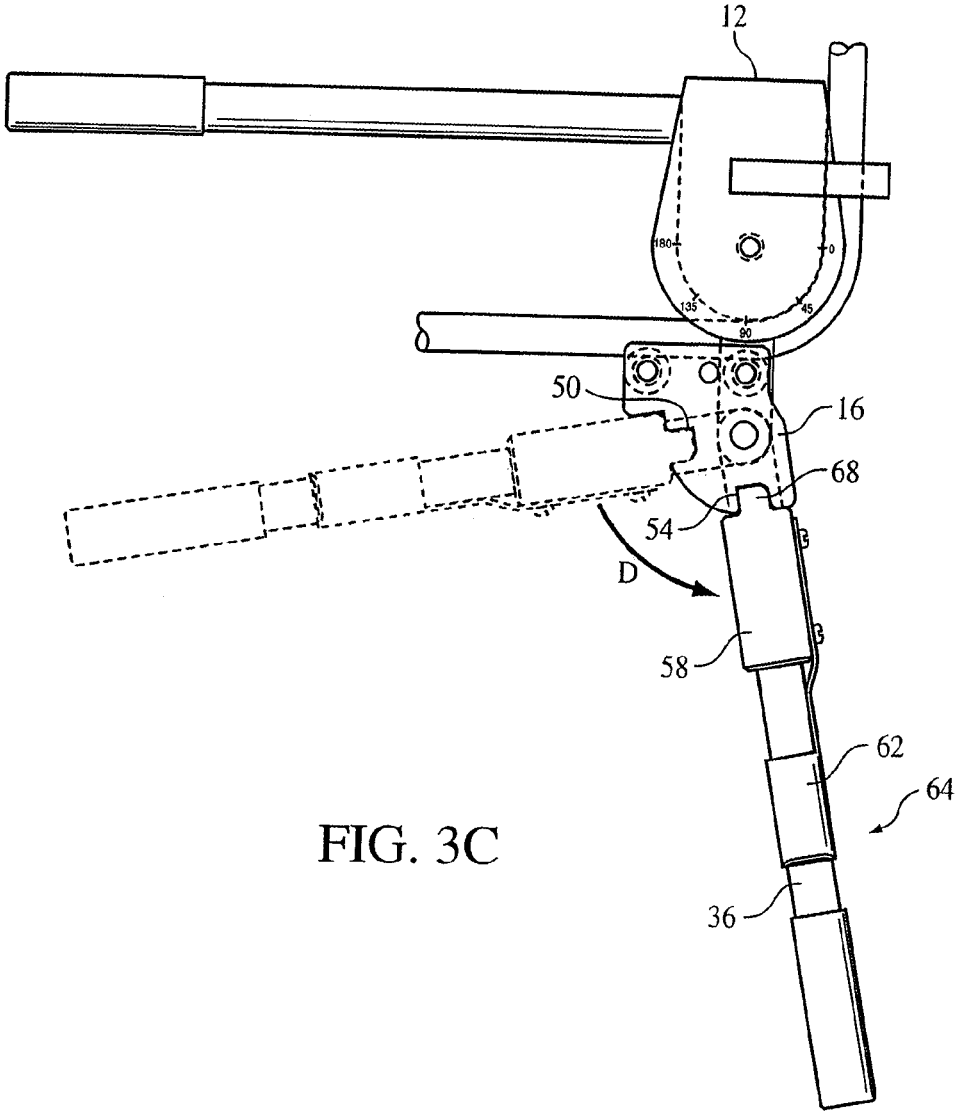

(shown in dashed lines in FIG. 3C) is then rotated counter-clockwise in the direction as indicated by arrow D in FIG. 3C to index it to the 90 to 180 degree bend position. Once handle 36 is moved to the 90-180 degree bend position, the spring will force the sleeve 58 and its tab 68 back into engagement with the second notch 54 thereby locking handle 36 (shown in solid lines in FIG. 3C) in its 90 to 180 degree position.

Figure 3D:
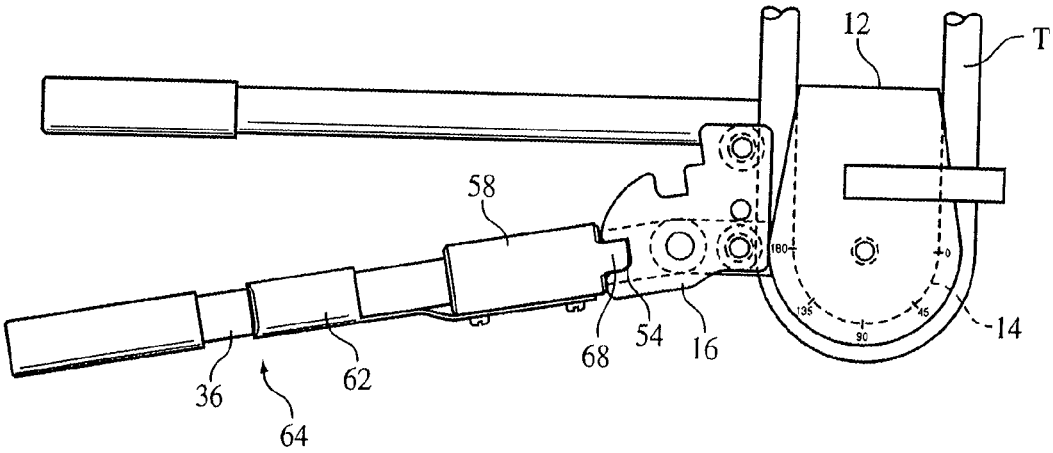

The operator once again grasps both handles 34, 36 and applies force to them to shift the handles 34, 36 from the position of FIG. 3C toward one another and effect a further bend beyond 90 degrees and up to 180 degrees as shown in FIG. 3D.

Figure 4:
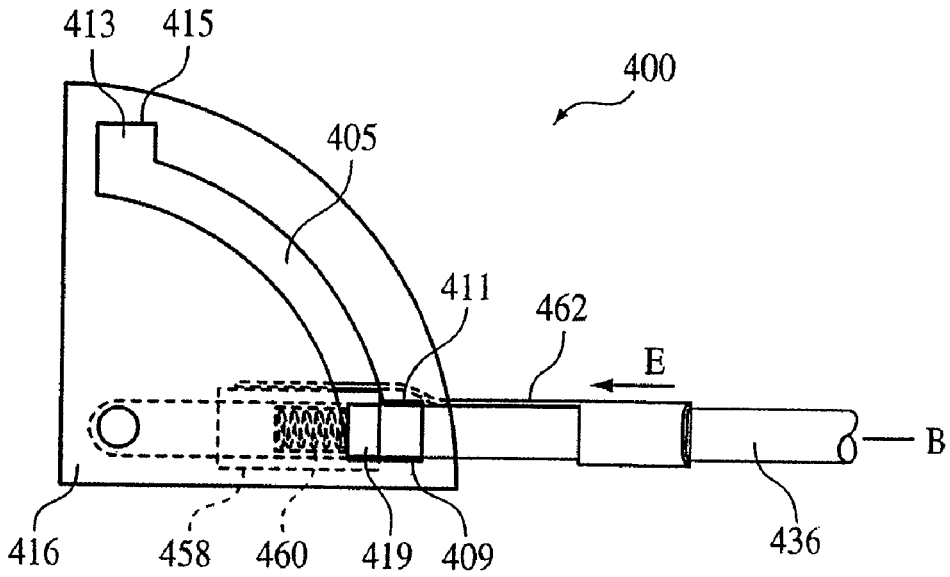
FIG. 4 is an enlarged fragmentary view of tube bender 400 according to an alternative embodiment of the present invention.

FIG. 4 illustrates another embodiment according to the present invention. FIG. 4 only illustrates the portion of tube bender 400 that is different from tube bender 10 illustrated in FIG. 1, since the rest of tube bender 400 is similar in structure to tube bender 10 depicted in FIG. 1. Further, tube bender 400 is operated in a similar manner as tube bender 10 except for the operation of indexing handle 436 between first and second bending positions.

In this embodiment, forming member 416 further includes a curved slot 405 that terminates into a first retention notch 409 at one end and a second retention notch 413 at the other end. First retention notch 409 defines a first bending position 411 and second retention notch 413 defines a second bending position 415. One skilled in the art would recognize that more than two bending positions may be provided along forming member 416 as described below and shown in FIG. 7. Sleeve 458 is disposed about and in a spring biased relationship with handle 436 wherein the spring 460 is biasing sleeve 458 away from forming member 416. Sleeve 458 includes a tab 419 that extends radially relative to the longitudinal handle axis B. Tab 419 is dimensioned such that sleeve 458 is in a locked position when it is situated in first retention notch 409 or second retention notch 413 thereby preventing movement of handle 436 relative to forming member 416. However, when sleeve 458 is in an unlocked position, tab 419 on sleeve 458 is capable of moving within slot 405 between first bending position 411 and second bending position 415. Although tab 419 extends radially from handle 436, tab 419 may extends axially if curved slot 405 is modified to permit clearance for sleeve 458.

In operation, the operator pushes the actuation lever 462 towards forming member 416 into slot 405 in the direction indicated by Arrow E to disengage tab 419 from either the first retention notch 409 or the second retention notch 413. Once tab 419 is disengaged, handle 436 is movable between the first bending position 411 and the second bending position 415 as tab 419 moves within slot 405. Therefore, when the operator wishes to situate handle 436 in any one bending position, the operator can release the actuation lever 462 thereby permitting tab 419 on sleeve 458 to return to the selected retention notch 409, 413 on its own because of the spring-biased relationship between sleeve 458 and handle 436. Once tab 419 of sleeve 458 returns to the selected retention notch 409, 413, tab 419 re-engages the selected retention notch 409, 413 thereby securing sleeve 458 in the locked position and preventing handle 436 from moving relative to forming member 416.

Although the preferred urging means is an actuation lever, other urging means may be utilized and still be within the scope of the present invention. Other urging means may include any other physical member connected to sleeve 458 to enable an operator to move sleeve 458 axially with a finger of the same hand holding handle 436 without having to reposition the operator's hand. Furthermore, urging means may include modifications to the sleeve itself to enable an operator to move sleeve 458 axially with a finger of the same hand holding handle 436 without having to reposition the operator's hand. These modifications to sleeve 458 may include, but are not limited to, providing a lip on the end of sleeve 458, providing a contoured surface on sleeve 458, knurling sleeve 458, or any other design modification to sleeve 458 known in the art to provide a surface for an operator to engage to permit axial movement of sleeve 458. Also, since this embodiment permits the operator to push sleeve 458 in the direction indicated by arrow E, it is obvious that urging means may not be necessary because the operator may simply just push the edge of sleeve 458 if it extends far enough in proximity to the operator's hand holding handle 436.

Figure 5:
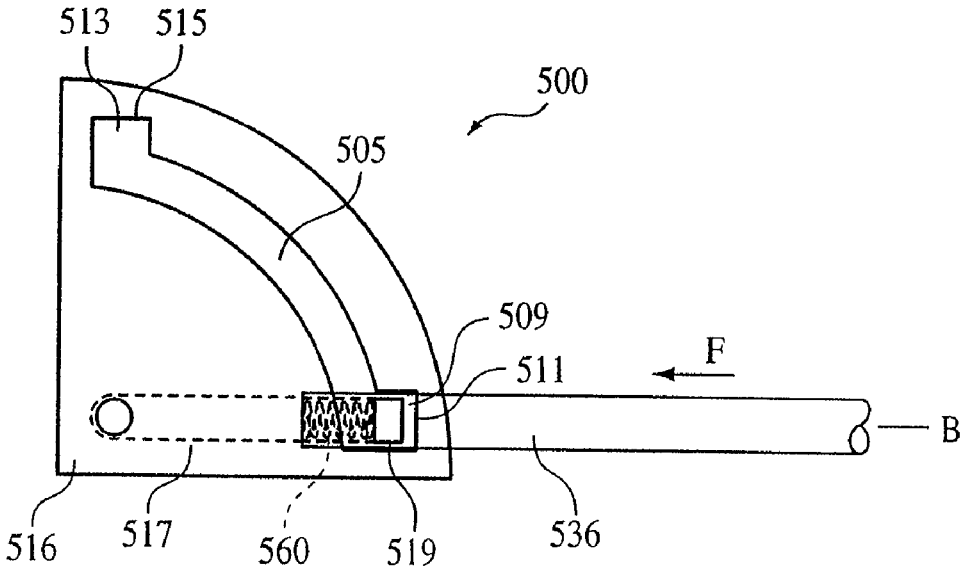
FIG. 5 is an enlarged fragmentary view of tube bender 500 according to an alternative embodiment of the present invention.

FIG. 5 illustrates another embodiment according to the present invention. FIG. 5 only illustrates the portion of tube bender 500 that is different from tube bender 10 illustrated in FIG. 1, since the rest of tube bender 500 is similar in structure to tube bender 10 depicted in FIG. 1. Further, tube bender 500 is operated in a similar manner as tube bender 10 except for the operation of indexing handle 536 between first and second bending positions.

In this embodiment, tube bender 500 includes a similar structure as tube bender 400 depicted in FIG. 4, except that handle 36 is split into two parts (i.e., handle 536 and following member 517), and sleeve 58 and actuation lever 62 are not required. Forming member 516 includes a curved slot 505 that terminates into a first retention notch 510 at one end and a second retention notch 512 at the other end. First retention notch 509 defines a first bending position 511 and second retention notch 513 defines a second bending position 515. One skilled in the art would recognize that more than two bending positions may be provided along forming member 516 as described below and shown in FIG. 7. Following member 517 is pivotally connected to forming member 516 defining a pivot point. Handle 536 is disposed about and is in a spring biased relationship with following member 517 wherein the spring 560 is biasing handle 536 away from forming member 516. Handle 536 includes a tab 519 that extends radially relative to the longitudinal handle axis B. Tab 519 is dimensioned such that handle 536 is in a locked position when it is situated in first retention notch 509 or second notch 513 thereby preventing movement of handle 536 relative to forming member 516. However, when handle 536 is in an unlocked position, tab 519 is capable of moving within slot 505 between first bending position 511 and second bending position 515.

Although the preferred following member is a shaft within a cavity provided in handle 536, it is obvious to one skilled in the art that the following member may include a sleeve disposed about handle 536. The shaft and cavity provided in handle 536 may be any geometric shape, but it is preferred that the shaft and the cavity provided in handle 536 are cylindrical shaped.

In operation, the operator pushes handle 536 towards forming member 516 into slot 505 in the direction indicated by Arrow F to disengage tab 514 from either the first retention notch 509 or the second retention notch 513. Once tab 519 is disengaged, handle 536 is movable between the first bending position 511 and the second bending position 515 as tab 519 moves within slot 505. Accordingly, when the operator wishes to situate handle 536 in any one bending position, the operator can stop pushing handle 536 towards forming member 516 thereby permitting tab 519 on handle 536 to return to the selected retention notch 509, 513 on its own because of the spring-biased relationship between handle 536 and following member 516. Once tab 519 of handle 536 returns to the selected retention notch 509, 513, tab 519 re-engages the selected retention notch 509, 513 thereby securing handle 536 in the locked position and preventing handle 536 from moving relative to forming member 516.

Figure 6:
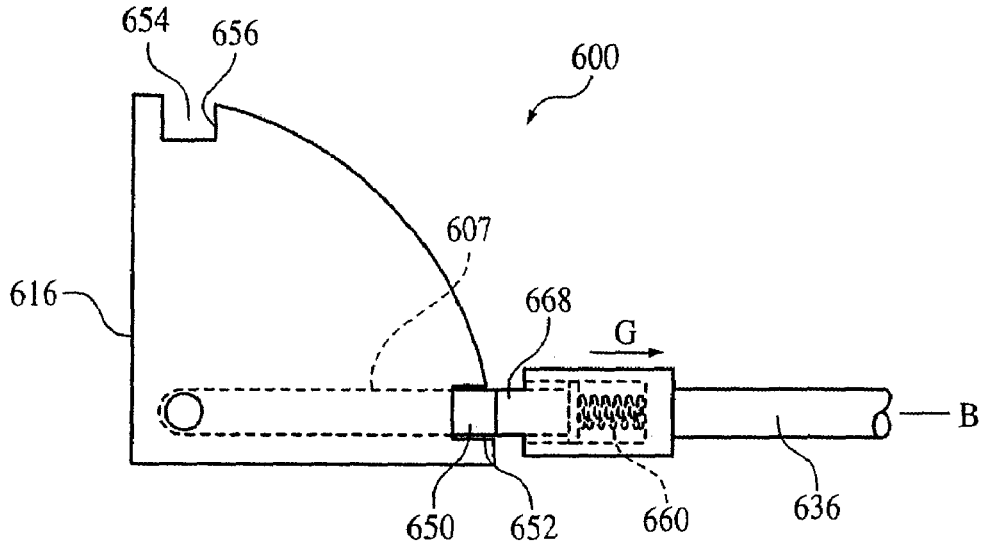
FIG. 6 is an enlarged fragmentary view of tube bender 600 according to an alternative embodiment of the present invention.

FIG. 6 illustrates another embodiment according to the present invention. FIG. 6 only illustrates the portion of tube bender 600 that is different from tube bender 10 illustrated in FIG. 1, since the rest of tube bender 600 is similar in structure to tube bender 10 depicted in FIG. 1. Further, tube bender 600 is operated in a similar manner as tube bender 10 except for the operation of indexing handle 636 between first and second bending positions.

In this embodiment, tube bender 600 includes a similar structure as tube bender 10 depicted in FIG. 1, except that handle 36 is split into two parts (i.e., handle 636 and following member 607), and sleeve 58 and actuation lever 62 are not required. Forming member 616 is similar to forming member 16 as depicted in FIG. 1. Forming member 616 includes a first retention notch 650 defining a first bending position 652, a second retention notch 654 defining a second bending position 656, and a channel (not shown) that extends at least between first and second retention notches 650, 654. One skilled in the art would recognize that more than two bending positions may be provided along forming member 616 as described below and shown in FIG. 7. Following member 607 is pivotally connected to forming member 616 defining a pivot point. Handle 636 is disposed about and is in a spring biased relationship with following member 607 wherein spring 660 is biasing handle 636 towards forming member 616. Handle 636 includes a tab 668 that extends axially relative to the longitudinal handle axis B. Tab 668 is dimensioned such that handle 636 is in a locked position when it is situated in first retention notch 650 or second notch 654 thereby preventing movement of handle 636 relative to forming member 616. However, when handle 636 is in an unlocked position, tab 668 on handle 636 is capable of moving within the channel (not shown) of forming member 616 between first bending position 652 and second bending position 656.

Although the preferred following member is a shaft within a cavity provided in handle 636, it is obvious to one skilled in the art that the following member may include a sleeve disposed about handle 636. The shaft and cavity provided in handle 636 may be any geometric shape, but it is preferred that the shaft and the cavity provided in handle 636 are cylindrical shaped.

Although the preferred engagement means includes retention notches 650, 654 provided in forming member 616 and a complimentary tab 668 provided on handle 636, one skilled in the art would appreciate that any female-type structure may be provided on forming member 616 and any complimentary male-type structure may be provided on sleeve 58 to engage the female-type structure on forming member 616. Further, one skilled in the art would recognize that forming member 616 may include any male-type structure, while handle 636 may include any complimentary female-type structure.

In operation, the operator pulls handle 636 away from forming member 616 in the direction indicated by Arrow G to disengage tab 668 from either the first retention notch 650 or the second retention notch 654. Once tab 668 is disengaged, handle 636 is movable between the first bending position 652 and the second bending position 656 as tab 668 moves within the channel (not shown). Accordingly, when the operator wishes to situate handle 636 in any one bending position, the operator can release handle 636 thereby permitting tab 668 on handle 636 to return to the selected retention notch 650, 654 on its own because of the spring-biased relationship between handle 636 and following member 607. Once tab 668 of handle 636 returns to the selected retention notch 650, 654, tab 668 re-engages the selected retention notch 650, 654 thereby securing handle 636 in the locked position and preventing handle 636 from moving relative to forming member 616.

Figure 7:
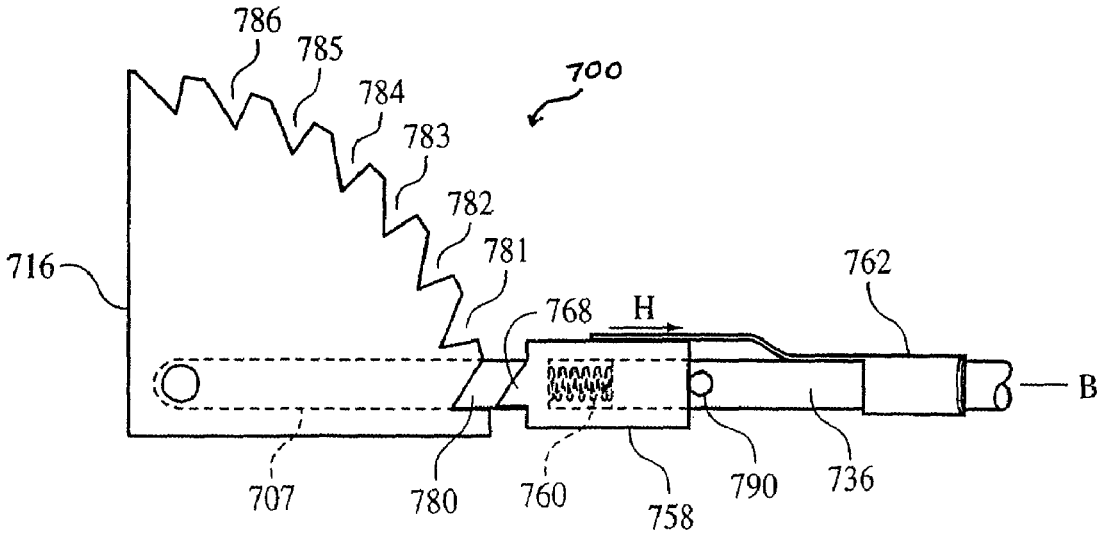
FIG. 7 is an enlarged fragmentary view of tube bender 700 according to an alternative embodiment of the present invention.

FIG. 7 illustrates another embodiment according to the present invention. FIG. 7 only illustrates the portion of tube bender 700 that is different from tube bender 10 illustrated in FIG. 1, since the rest of tube bender 700 is similar in structure to tube bender 10 depicted in FIG. 1. Further, tube bender 700 is operated in a similar manner as tube bender 10 except for the operation of indexing handle 736 between the bending positions.

In this embodiment, forming member 716 includes a plurality of retention notches 780-786 each defining a bending position. Sleeve 758 is disposed about and in a spring biased relationship with handle 736 wherein the spring 760 is biasing sleeve 758 towards forming member 716. Sleeve 758 includes a tab 768 that extends axially relative to the longitudinal handle axis B. Tab 768 is dimensioned such that sleeve 758 is in a locked position when it engages any of the retention notches 780-786 thereby preventing movement of handle 736 relative to forming member 716. However, when sleeve 758 is in an unlocked position, handle 736 is capable of moving within the channel (not shown) between any of the bending positions. Optionally, the shape of retention notches 780-786 and the complimentary tab 768 may be dimensioned such that sleeve 758 may be self-actuated (i.e., ratcheted) when handle 736 is rotated in the counter-clockwise direction. Locking pin 790 may be provided in handle 736 to prevent ratcheting.

Although the preferred engagement means includes retention notches 780-786 (having a triangular shaped recess) provided in forming member 716 and a complimentary tab 768 (having a triangular shaped tooth) provided on sleeve 758, one skilled in the art would appreciate that any female-type structure may be provided on forming member 716 and any complimentary male-type structure may be provided on sleeve 758 to engage the female-type structure on forming member 716. Further, one skilled in the art would recognize that forming member 716 may include any male-type structure, while sleeve 758 may include any complimentary female-type structure.

In operation, the operator pulls actuation lever 762 away from forming member 716 in the direction indicated by Arrow H to disengage tab 768 from any of the retention notches 780-786. Once tab 768 is disengaged, handle 736 is movable between any of the bending positions within the channel (not shown). Therefore, when the operator wishes to situate handle 736 in any one bending position, the operator can release actuation lever 762 thereby permitting tab 768 on sleeve 758 to return to the selected retention notch 780-786 on its own because of the spring-biased relationship between sleeve 758 and handle 736. Once tab 768 of sleeve 758 returns to the selected retention notch 780-786, tab 768 re-engages the selected retention notch 780-786 thereby securing sleeve 758 in the locked position and preventing handle 736 from moving relative to forming member 716.

Although the preferred urging means is an actuation lever, other urging means may be utilized and still be within the scope of the present invention. Other urging means may include any other physical member connected to sleeve 758 to enable an operator to move sleeve 758 axially with a finger of the same hand holding handle 736 without having to reposition the operator's hand. Furthermore, urging means may include modifications to the sleeve itself to enable an operator to move sleeve 758 axially with a finger of the same hand holding handle 736 without having to reposition the operator's hand. These modifications to sleeve 758 may include, but are not limited to, providing a lip on the end of sleeve 758, providing a contoured surface on sleeve 758, knurling sleeve 758, or any other design modification to sleeve 758 known in the art to provide a surface for an operator to engage to permit axial movement of sleeve 758.

Figure 8A:
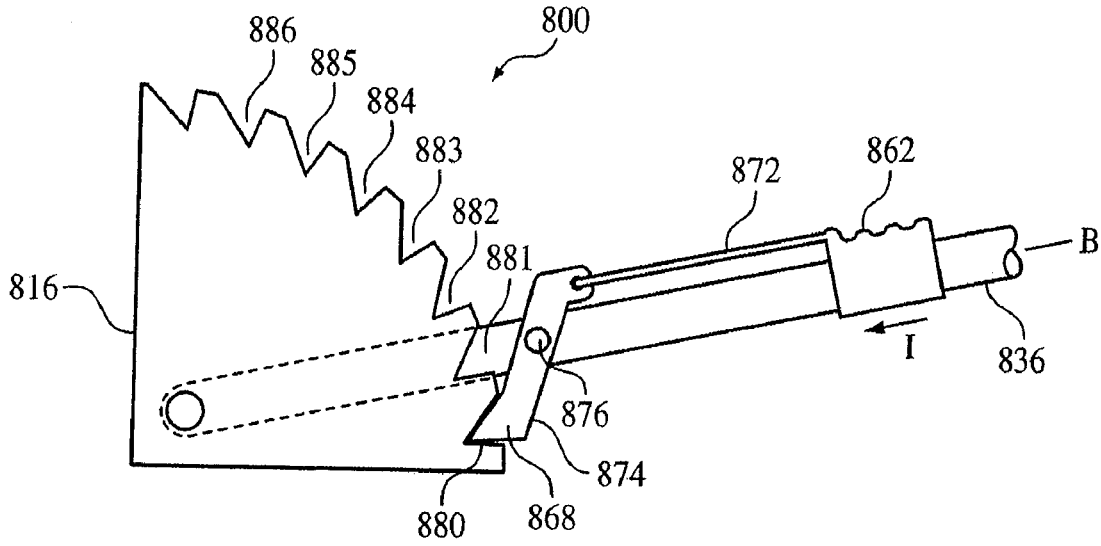
FIG. 8A is an enlarged fragmentary view of tube bender 800 according to an alternative embodiment of the present invention.

FIG. 8A illustrates another embodiment according to the present invention. FIG. 8A only illustrates the portion of tube bender 800 that is different from tube bender 10 illustrated in FIG. 1, since the rest of tube bender 800 is similar in structure to tube bender 10 depicted in FIG. 1. Further, tube bender 800 is operated in a similar manner as tube bender 10 except for the operation of indexing handle 836 between first and second bending positions.

In this embodiment, forming member 816 includes a plurality of retention notches 880-886 each defining a bending position. A release member 874 is pivotally connected to handle 836 via pin 876. Release member 874 includes a complimentary tab 868 that is dimensioned such that release member 874 is in a locked position when tab 868 engages any of the retention notches 880-886 thereby preventing movement of handle 836 relative to forming member 816. However, when release member 874 is in an unlocked position, handle 836 is capable of moving within the channel (not shown) between any of the bending positions. Release member 874 is connected to an actuation lever 862 via link 872. Optionally, the shape of retention notches 880-886 and the complimentary tab 868 may be dimensioned such that release member 874 may be self-actuated (i.e., ratcheted) when handle 836 is rotated in the counter-clockwise direction.

In operation, the operator pushes actuation lever 862 away from forming member 816 in the axial direction indicated by Arrow I forcing release member 874 to pivot on pin 876. The pivotal movement of release member 874 causes tab 868 to pivot away from any of the retention notches 880-886 thereby disengaging tab 868 from any of the retention notches 880-886. Once tab 868 is disengaged, handle 836 is movable between any of the bending positions within the channel (not shown). Therefore, when the operator wishes to situate handle 836 in any one bending position, the operator can release actuation lever 862 thereby permitting tab 868 on release member 874 to return to the selected retention notch 880-886 on its own. Once tab 868 of release member 874 returns to the selected retention notch 880-886, tab 868 re-engages the selected retention notch 880-886 thereby securing release member 874 in the locked position and preventing handle 836 from moving relative to forming member 816.

Figure 8B:
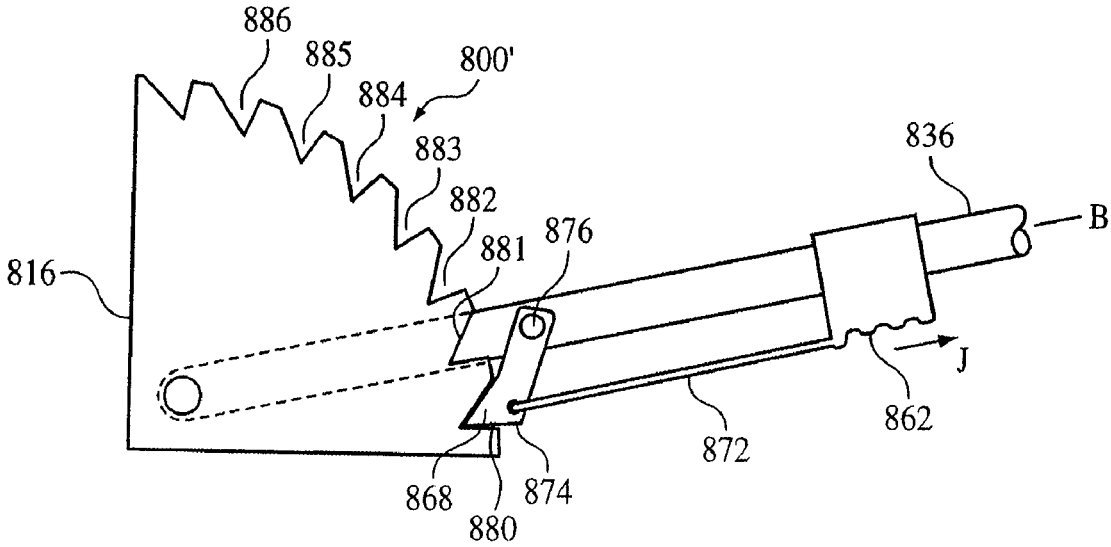
FIG. 8B is an enlarged fragmentary view of tube bender 800' according to an alternative embodiment of the present invention.

FIG. 8B illustrates another embodiment according to the present invention. FIG. 8A only illustrates the portion of tube bender 800' that is different from tube bender 10 illustrated in FIG. 1, since the rest of tube bender 800 is similar in structure to tube bender 10 depicted in FIG. 1. Further, tube bender 800' is operated in a similar manner as tube bender 10 except for the operation of indexing handle 836 between first and second bending positions.

In this embodiment, tube bender 800' is very similar in structure to tube bender 800. Forming member 816 includes a plurality of retention notches 880-886 each defining a bending position. A release member 874' is pivotally connected to handle 836 via pin 876. Release member 874 includes a complimentary tab 868 that is dimensioned such that release member 874 is in a locked position when tab 868 engages any of the retention notches 880-886 thereby preventing movement of handle 836 relative to forming member 816. However, when release member 874 is in an unlocked position, handle 836 is capable of moving within the channel (not shown) between any of the bending positions. Release member 874 is connected to an actuation lever 862 via link 872. Optionally, the shape of retention notches 880-886 and the complimentary tab 868 may be dimensioned such that release member 874 may be self-actuated (i.e., ratcheted) when handle 836 is rotated in the counter-clockwise direction.

In operation, the operator pulls actuation lever 862 away from forming member 816 in the axial direction indicated by Arrow J forcing release member 874 to pivot on pin 876. The pivotal movement of release member 874 causes tab 868 to pivot away from any of the retention notches 880-886 thereby disengaging tab 868 from any of the retention notches 880-886. Once tab 868 is disengaged, handle 836 is movable between any of the bending positions within the channel (not shown). Therefore, when the operator wishes to situate handle 836 in any one bending position, the operator can release actuation lever 862 thereby permitting tab 868 on release member 874' to return to the selected retention notch 880-886 on its own. Once tab 868 of release member 874' returns to the selected retention notch 880-886, tab 868 re-engages the selected retention notch 880-886 thereby securing release member 874' in the locked position and preventing handle 836 from moving relative to forming member 816.

Although the preferred engagement means includes retention notches 880-886 (having a triangular shaped recess) provided in forming member 816 and a complimentary tab 868 (having a triangular shaped tooth) provided on release member 874, one skilled in the art would appreciate that any female-type structure may be provided on forming member 816 and any complimentary male-type structure may be provided on release member 874 to engage the female-type structure on forming member 816. Further, one skilled in the art would recognize that forming member 816 may include any male-type structure, while release member 874 may include any complimentary female-type structure.

Although the preferred urging means is an actuation lever, other urging means may be utilized and still be within the scope of the present invention. Other urging means may include any other physical member connected to release member 874, 874' to enable an operator to pivotally move release member 874, 874' with a finger of the same hand holding handle 836 without having to reposition the operator's hand. Furthermore, urging means may include modifications to the release member 874, 874' itself to enable an operator to pivotally move release member 874, 874' with a finger of the same hand holding handle 836 without having to reposition the operator's hand. These modifications to release member 874, 874' may include, but are not limited to, providing a lip on the end of release member 874, 874', providing a contoured surface on release member 874, 874', knurling release member 874, 874', or any other design modification to release member 874, 874' known in the art to provide a surface for an operator to engage to permit pivotal movement of release member 874, 874'.

Figure 9:
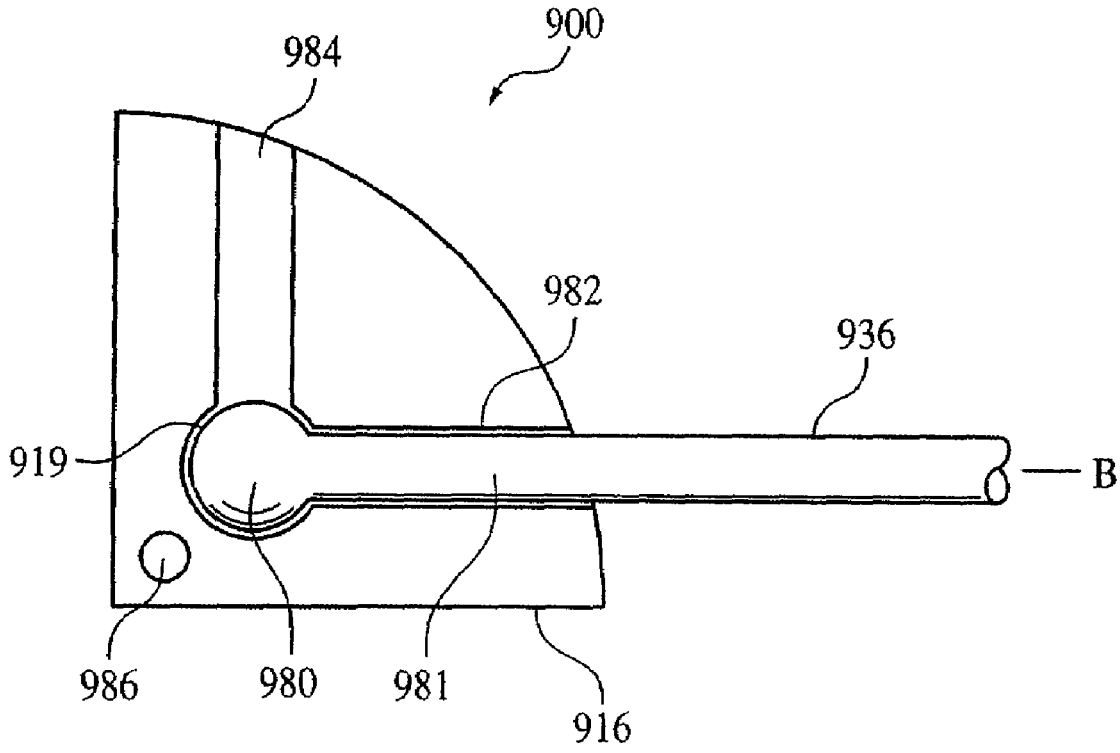
FIG. 9 is an enlarged fragmentary view of tube bender 900 according to an alternative embodiment of the present invention.

FIG. 9 illustrates another embodiment according to the present invention. FIG. 9 only illustrates the portion of tube bender 900 that is different from tube bender 10 illustrated in FIG. 1, since the rest of tube bender 800 is similar in structure to tube bender 10 depicted in FIG. 1. Further, tube bender 900 is operated in a similar manner as tube bender 10 except for the operation of indexing handle 936 between first and second bending positions.

In this embodiment, forming member 916 is connected to the link (not shown) via pin 986 to permit forming member 916 to swing around the mandrel (not shown). Forming member 916 includes a socket 919 in communication with a first channel 982 defining a first bending position and a second channel 984 defining a second bending position. The first channel 982 and the second channel 984 are provided in a first geometric plane. Handle 936 includes a ball portion 980 disposed in the socket and a shaft portion 981 disposable in either the first channel 982 or the second channel 984 for securing handle 936 in a locked position relative to forming member 916 when handle 936 is selectively moved to any of one of the two bending positions thereby preventing relative movement between handle 936 and forming member 916. Handle 936 is adapted to enable an operator to move handle 936 into a geometric plane different than the first plane to an unlocked position to permit such operator to move handle 936 relative to forming member 916 between the two bending positions.

In operation, the operator moves shaft portion 981 of handle 936 in a different geometric plane out from either first or second channel 982, 984 that are provided in a first geometric plane. Once shaft portion 981 of handle 936 is clear from either first or second channel 982, 984, handle 936 is movable between the two bending positions. Therefore, when the operator wishes to situate handle 936 in any one bending position, the operator can move shaft portion 981 of handle 936 back into either first or second channel 982, 984 to secure shaft portion 981 of handle 936 in the locked position thereby preventing handle 936 from moving relative to forming member 916.

Although the preferred biasing element for all embodiments discussed above is a spring, one skilled in the art would appreciate that any type of biasing element may be utilized and still be within the scope of the present invention.

Although the invention has been described with reference to the preferred embodiments, it will be apparent to one skilled in the art that variations and modifications are contemplated within the spirit and scope of the invention. The drawings and description of the preferred embodiments are made by way of example rather than to limit the scope of the invention, and it is intended to cover within the spirit and scope of the invention all such changes and modifications.

What is claimed is:

1. A manually operable tube bender comprising:

a grooved member configured to receive a tube;

a forming member configured to engage the tube received by the grooved member, wherein the forming member has at least two bending positions defined thereon, one being a 0-90 degree bending position and the other being a 90-180 degree bending position;

at least two handles, the at least two handles including a first handle connected to the grooved member and a second handle connected to the forming member, wherein the second handle is selectively movable between the at least two bending positions;

an engaging member associated with the second handle, the engaging member biased towards the forming member and configured to engage the forming member at each of the at least two bending positions; and a tube anchoring hook pivotally connected to the grooved member.

2. The tube bender of claim 1, wherein the second handle is pivotally connected to the forming member.

3. The tube bender of claim 1, wherein the grooved member is a mandrel.

4. The tube bender of claim 1, further comprising means for releasing the engaging member from the forming member.

5. The tube bender of claim 4, wherein the means for releasing the engaging member is configured to be actuated by a finger of an operator.

6. The tube bender of claim 4, wherein the means for releasing the engaging member is a sleeve disposed about the handle.

7. The tube bender of claim 1, wherein the engaging member has a first shape and the at least two bending positions have complementary shapes for receiving the engaging member.

8. The tube bender of claim 1, wherein the at least two bending positions comprise at least two notches configured to receive the engaging member.

9. A manually operable tool for bending a tube, the tool comprising:

a tube receiving member having a groove that extends at least 180 degrees around the tube receiving member;

a forming member having at least two retention locations and at least two rollers; and at least two handles, the at least two handles including at least a first handle and a second handle, wherein the first handle is connected to the tube receiving member, and wherein the second handle is configured to be connected to the forming member at the at least two retention locations via a non-threaded connection.

10. The tool of claim 9, wherein the second handle is pivotally connected to the forming member.

11. The tool of claim 9, further comprising a release member configured to release the engaging member from one of the at least two retention locations.

12. The tool of claim 11, wherein the release member is configured to be operated by a finger of an operator.

13. The tool of claim 9, further comprising a sleeve disposed about the second handle, wherein the sleeve is biased towards the forming member.

14. The tool of claim 11, wherein the at least two retention locations includes at least two notches configured to receive the sleeve.

15. The tool of claim 9, wherein each of the at least two retention locations is defined by a retention notch.

16. The tool of claim 9, wherein the tube receiving member is a mandrel having a groove disposed therein that extends at least 180 degrees around the mandrel.

17. A manually operable tool for bending a tube, the tool comprising:

a tube receiving member having a groove that extends at least 180 degrees around the tube receiving member;

a forming member having at least two retention locations;

at least two handles, the at least two handles including at least a first handle and a second handle, wherein the first handle is connected to the tube receiving member and wherein the second handle is configured to be connected to the forming member at the at least two retention locations via a non-threaded connection; and a release member configured to release the engaging member from one of the at least two retention locations and configured to be operated by a finger of an operator.

18. The tool of claim 17, wherein each of the at least two retention locations is defined by a retention notch.

19. The tool of claim 17, wherein the tube receiving member is a mandrel having a groove disposed therein that extends at least 180 degrees around the mandrel.

* * * * *